US008561252B2

(12) United States Patent
Demmeler

(10) Patent No.: US 8,561,252 B2
(45) Date of Patent: Oct. 22, 2013

(54) VALUE DOCUMENT PROCESSING DEVICE AND METHOD FOR REDUCING DUST IN THE VALUE DOCUMENT PROCESSING DEVICE

(75) Inventor: Erwin Demmeler, Memmingen (DE)

(73) Assignee: Giesecke & Devrient GmbH, Munich (DE)

( * ) Notice: Subject to any disclaimer, the term of this patent is extended or adjusted under 35 U.S.C. 154(b) by 63 days.

(21) Appl. No.: 13/062,729

(22) PCT Filed: Sep. 7, 2009

(86) PCT No.: PCT/EP2009/006472
§ 371 (c)(1),
(2), (4) Date: Mar. 8, 2011

(87) PCT Pub. No.: WO2010/025949
PCT Pub. Date: Mar. 11, 2010

(65) Prior Publication Data

US 2011/0162679 A1 Jul. 7, 2011

(30) Foreign Application Priority Data

Sep. 8, 2008 (DE) ..... 10 2008 046 254

(51) Int. Cl.
*A47L 5/00* (2006.01)

(52) U.S. Cl.
USPC ..... 15/303; 15/306.1; 15/308; 15/309.2; 15/312.2; 15/339; 53/54; 53/500; 53/510; 209/534

(58) Field of Classification Search
USPC ..... 15/303, 306.1, 308, 312.2, 309.2, 339; 53/54, 500, 510; 209/534
IPC ..... A47L 5/00
See application file for complete search history.

(56) References Cited

U.S. PATENT DOCUMENTS 3,395,042 A 7/1968 Herbert
4,376,364 A 3/1983 Horino et al.

(Continued)

FOREIGN PATENT DOCUMENTS

DE 4120973 A1 1/1993
DE 20311648 U1 10/2003

(Continued)

OTHER PUBLICATIONS

International Search Report in PCT/EP2009/006472, Sep. 8, 2008.

(Continued)

*Primary Examiner* — David Redding
(74) *Attorney, Agent, or Firm* — Bacon & Thomas, PLLC

(57) ABSTRACT

A value document processing apparatus comprises an input for value documents to be processed, an output and/or a storage device for processed value documents, a transport device for singled transport of value documents from the input to the output or the storage device, a housing, a checking device arranged in the housing for checking value documents transported in singled form past it, and a suction conduit system for suction air which has a port for a suction unit for sucking air with dust out of the suction conduit system, and at least one hand cleaning portion connected to the port and having a suction opening movable in the area of the checking device, and/or at least two conduit portions connected to the port and having suction openings arranged at different portions of the transport path and directed onto the transport path.

42 Claims, 10 Drawing Sheets

(56) References Cited

U.S. PATENT DOCUMENTS

| | | | | |
|---|---|---|---|---|
| 6,868,785 | B2 | 3/2005 | Dohner et al. | |
| 2005/0081325 | A1 | 4/2005 | Park | |
| 2010/0007075 | A1 * | 1/2010 | Ito et al. | 271/3.04 |
| 2010/0032351 | A1 | 2/2010 | Schmidt | |

FOREIGN PATENT DOCUMENTS

| | | | |
|---|---|---|---|
| DE | 102006042186 | A1 | 3/2008 |
| EP | 2110792 | A1 | 12/2010 |
| GB | 2056415 | A | 3/1981 |
| GB | 2337325 | A | 11/1999 |
| RU | 2112277 | C1 | 5/1998 |
| RU | 2264157 | C1 | 11/2005 |
| WO | 2008028581 | | 3/2008 |
| WO | 2008096427 | A1 | 8/2008 |

OTHER PUBLICATIONS

Search Report of German Patent Office regarding German Patent Application No. 10 2008 046 254.3, Jul. 13, 2009.

* cited by examiner

VALUE DOCUMENT PROCESSING DEVICE AND METHOD FOR REDUCING DUST IN THE VALUE DOCUMENT PROCESSING DEVICE

FIELD OF THE INVENTION

The present invention relates to a value document processing apparatus and to a method for reducing dust in a housing of the value document processing apparatus.

BACKGROUND

Value documents will be understood here to mean sheet-shaped objects that represent for example a monetary value or an authorization and, hence, should not be producible arbitrarily by unauthorized persons. Hence, they have features that are not easily produced, in particular copied, whose presence is an indication of authenticity, i.e. production by an authorized body. Important examples of such value documents are coupons, vouchers, checks and in particular bank notes.

On account of the great number of value documents in circulation and the need to check them, there exist value document processing apparatuses that serve to check the value documents by machine, for example for their authenticity, fitness for circulation or denomination. For this purpose, value document processing apparatuses frequently have checking devices for checking value documents according to given criteria, which can in particular possess optical sensors. The checking devices and in particular optical sensors of such checking devices are in general sensitive to soiling, in particular dust which can settle on parts of the checking device, for example a window of an optical sensor through which optical radiation passes to or from the value document. As of a certain degree of soiling, the checking device must be cleaned, which requires effort and limits the possible operating time of the value document processing apparatus.

SUMMARY

Hence, the invention is based on the object of providing a value document processing apparatus having a checking device for checking value documents wherein a soiling by dust can be reduced, and of supplying a corresponding method for reducing dust in such a value document processing apparatus.

This object is achieved by a method for reducing dust in a housing of a value document processing apparatus, said apparatus having an input for value documents to be processed, an output and/or a storage device for processed value documents, a transport device for singled transport of value documents from the input along a transport path to the output or the storage device, and a checking device arranged in the housing for checking value documents transported in singled form past it, whereby, in the method, dust is sucked off at at least two different places on the transport path and/or through a hand cleaning portion having a suction opening movable, relative to the checking device, into the area of the checking device.

The object is further achieved by a value document processing apparatus having an input for value documents to be processed, an output and/or a storage device for processed value documents, a transport device for singled transport of value documents from the input along a transport path to the output or the storage device, a housing, a checking device arranged in the housing for checking value documents transported in singled form past it, and having a suction conduit system for suction air which has a port for a suction unit for sucking air with dust out of the suction conduit system, and at least one hand cleaning portion connected to the port and having a suction opening movable in the area of the checking device relative thereto, and/or at least two conduit portions connected to the port and having suction openings arranged at different portions of the transport path and directed onto the transport path, through which openings dust is transportable from value documents transported along the transport path.

The value document processing apparatus serves to process value documents by machine. Processing can be understood here to mean in particular the counting of value documents and/or the checking of value documents according to given criteria and/or the sorting of value documents, for example in dependence on the result of a check or on other criteria. Checking of the value documents can comprise in particular the ascertainment of the type of the value documents, in the case of bank notes for example their denomination, and/or the check for authenticity or the presence of a forgery on the basis of given criteria for authenticity or the presence of a forgery, and/or the check of the state of the value documents, in particular their fitness for circulation and/or their suitability for use in money dispensing machines. For processing, the value documents can be input to the input or input device for value documents to be processed, individually or preferably as a stack, depending on the configuration of the value document processing apparatus. For outputting or receiving processed value documents there is used the output or output device and/or the storage device for processed value documents, which can comprise for example at least one pocket or a value document store, for example a cassette or a winding store. For processing, the value documents can be transported with the transport device out of the input preferably in singled form along the transport path, whose course is given by the transport device, to the output or the storage device. The checking device employed for checking is arranged at the transport path, so that it can serve for checking value documents transported in singled form past it.

For protection from soiling and mechanical effects from outside, and for mechanical and acoustic protection of operating staff, the value document processing apparatus possesses the housing, which can be constructed in one-part or multi-part fashion and at least partly encloses the component groups, in particular the input, the output, the transport device and the checking device of the value document processing apparatus. Preferably, the housing encloses the stated component groups to a great extent, particularly preferably completely, except for input and output openings for the value documents to be processed and those processed, respectively.

The checking device can be constructed for carrying out the above-mentioned ascertainments or checks, and comprise for this purpose at least one sensor by means of which physical, in particular also optical, properties of the value document can be captured and checked. Frequently, the checking device will also comprise several sensors.

For reducing dust in the interior of the housing and thus in particular also in the area of the checking device, more precisely of a sensor of the checking device, there are provided two measures which can be taken independently of each other individually or preferably in combination.

On the one hand, dust can be sucked from the transport path or the value documents transported therealong at at least two places on the transport path. Thus, the dust concentration in the housing can be lowered preventively by dust being sucked off in the area of its formation i.e. upon transport of the value documents, in particular from soiled value documents, before it can pass into the area of the checking device, in particular of a sensor of the checking device.

On the other hand, there can be provided a hand cleaning portion having a suction opening movable relative to the checking device in the area of the checking device, through which dust is sucked off. Thus, a servicing person can clean a soiled sensor of the checking device easily by moving the suction opening such that the dust is sucked off at a suitable place and thus removed from the interior of the housing at least in the area of the checking device, preferably from the total interior of the housing, optionally except for a receptacle for the sucked off dust. Suction offers the advantage, compared with other alternatives such as blowing off or wiping off dust, that the dust is also removed from the checking device at places that are for example poorly accessible to wiping and from the internal space of the housing. This has the advantage that the cleaning effect lasts longer than in the case of blowing off dust.

The value document processing apparatus has for this purpose the suction conduit system which first has the port to which a suction unit, i.e. a device for generating a negative pressure, can be attached. As a suction unit there can be employed in particular a pump which can have a receptacle or a dust collecting device, for example a dust bag, for receiving dust from the sucked off air. The suction unit need not necessarily be part of the value document processing apparatus. The port can be arranged in particular in a wall of the housing or within the housing.

The suction conduit system further has at least one suction conduit connected as tightly as possible to the port, through which air and in particular dust can be sucked off through the port. In this connection, at least two types of suction conduits or suction conduit portions are possible, which can be present alternatively or cumulatively.

On the one hand, there can be provided the hand cleaning portion whose suction opening is movable in the area of the checking device.

On the other hand, there can be provided the at least two conduit portions having suction openings. The conduit portions can form branches of a portion connected to the port, or be part of the same conduit. The two conduit portions can be arranged in particular stationary relative to the checking device or the housing. The suction openings can be aligned arbitrarily here, but preferably they are directed onto the transport path, particularly preferably in such a way that air is sucked off orthogonally to the surface of transported value documents or tangentially to the surface of transported value documents.

This value document processing apparatus is suited in particular for carrying out the above-mentioned method.

The hand cleaning portion is arranged within the housing preferably at least while it not being used for suction, particularly preferably completely. This permits a more advantageous design of the housing and prevents mechanical damage.

The hand cleaning portion can be constructed in principle arbitrarily. For example, it can have two rigid parts connected by a joint, one part having the suction opening. However, there is preferably employed as a hand cleaning portion, in the method, a portion which has a flexible conduit member, preferably a hose, at whose free end there is preferably arranged a suction brush having the suction opening. In the value document processing apparatus, the hand cleaning portion can have a flexible conduit member, preferably a hose, at whose free end there is preferably arranged a suction brush having the suction opening. The use of a hose offers the advantage that the hand cleaning portion is very simple and cost-efficient to produce and furthermore also permits extensive freedom in moving the suction opening.

The at least two conduit portions are preferably likewise arranged within the housing. Their arrangement is in principle arbitrary, but the following embodiments, which can be applied alternatively or cumulatively, have proved to be especially effective.

Thus, in the method, dust can preferably be sucked off at at least one of the at least two places in such a way that dust is sucked from two different sides of a value document. In the value document processing apparatus, the suction openings of the at least two conduit portions or two suction openings of one of the at least two conduit portions, i.e. the at least one suction opening of the conduit portion and a further suction opening of the conduit portion, can thus be arranged in such a way that dust is sucked from two different sides of a value document. This has the advantage that the dust input through the value documents is kept particularly low. In particular, dust can thus be sucked off at one of the at least two places for example from a first side of a value document and at another of the at least two places from the first opposing side of the value document.

Fundamentally, dust or air with dust only needs to be sucked off at the small place on the transport path. However, dust is preferably sucked off, in the method, at at least one of the at least two places across the total width of the value documents. This makes possible an especially extensive suction of dust, in particular also at edges of a value document. In the value document processing apparatus, at least one of at least two conduit portions can thus have altogether several suction openings which are arranged perpendicular to the transport direction of the value documents, preferably across the total width. Alternatively, the suction opening can also be of slot-shaped configuration and extend with its longer side perpendicular to the transport direction, preferably across the total width of the transport path or of the value document.

In this connection, they are preferably arranged at the places on the transport path where dust can be detached from or rubbed off the value documents by mechanical stress thereon.

In this connection, the hereinafter stated possibilities can be employed alternatively or cumulatively.

Thus, in the method, the input can have a singling device for singling value documents of a stack of value documents to be processed, and transferring them to the transport device, and at least one of the places can be located at the singler and/or at a transition point between the singler and the transport device. In the value document processing apparatus, the input can thus have a singling device for singling value documents of a stack of value documents to be processed and transferring them to the transport device, and the at least one suction opening of at least one of the portions can be arranged at the singler and/or at a transition point between the singler and the transport device, preferably in order to remove dust resulting upon singling. The transition point is preferably located within the housing. This alternative offers the advantage that dust can be sucked off very early during transport. Particularly dust clinging only slightly to the surface of value documents can thus be removed at an early stage.

Further, in the method, the transport path can have a bend, and at least one of the places be located at the bend. In the value document processing apparatus, the transport path can thus have a bent portion and the at least one suction opening of one of the portions be arranged at the bent portion.

Also, in the method, a value document can be diverted at a diverting point upon transport, whereby at least one of the places is located at the diverting point. The transport device, in particular for forming the bend, can thus have at least one diverting roller at which the direction of the transport path is changed, and the at least one suction opening of the at least one conduit portion can be arranged at the diverting roller.

Furthermore, in the method, at least one of the places can be located at a portion of the transport path over which value documents are transported in beltless fashion, preferably over pairs of rollers. In the value document processing apparatus, the at least one suction opening of one of the at least two conduit portions can thus be arranged at a portion of the transport device which is configured for beltless transport of value documents and has for this purpose preferably at least one driven pair of rollers, particularly preferably at least two driven pairs of rollers. Because in such portions a particularly great amount of dust can arise through wear, suction is especially effective here.

Further, in the method, the transport path can have two consecutive bends or diverting points, and at least one of the places be located between the bends or diverting points. In the value document processing apparatus, the transport path can thus have two consecutive bent portions, or the transport device two diverting rollers, and the at least one suction opening of one of the portions be arranged between the bent portions or between the diverting rollers.

Also, the transport device can have a portion which transports the value documents by means of at least one transport belt, and a belt-free portion which transports the value documents without a transport belt. In the method, at least one of the places can then be located at the transition point between the portions. In the value document processing apparatus, the transport device thus preferably has a transport portion which transports the value documents by means of at least one transport belt, and a belt-free transport portion which transports the value documents without a transport belt, and the at least one suction opening of at least one of the suction conduit system portions is arranged at the transition point between the transport portions. This option offers the advantage that dust possibly arising through slip between the value document and the transport device upon the transition between the transport portions is already sucked off locally before it can pass into the area of the checking device.

Further, the checking device can have an optical sensor with a sensor window arranged at the transport path. In the method, one of the places can then be located at or opposite the sensor window. In the value document processing apparatus, the at least one suction opening of one of the at least two portions can thus be arranged at or opposite the sensor window.

In principle, the conduit portions can be configured arbitrarily, in particular in the area of the suction opening. However, it is preferred that at least one of the portions has a guiding device for value documents or for guiding value documents, in which device the at least one suction opening is formed. This makes it possible to achieve that even in the event that parts of a, for example, limp value document are drawn in the direction of the suction opening, the probability of a transport malfunction is substantially reduced thanks to the guidance on the guiding device. The guiding device need only be so configured that it has a guiding effect in the event of excessive deflection of portions of a value document, but not upon normal transport.

In particular, the guiding device can have ribs extending in the transport direction between which the at least one suction opening is arranged. This embodiment has the advantage that a clinging of a value document to the suction opening and thus a strong slowing down can be avoided with a high degree of certainty.

The suction conduit system can be configured arbitrarily. Thus, the suction conduit system can exclusively have firmly interconnected portions. However, it is also possible that, in the value document processing apparatus, the housing has a housing opening through which access is possible at least to the checking device, and a cover element for covering the housing opening, said cover element being movable between an open position in which access to the checking device is possible, and a covering position in which the housing opening is covered at least partly, preferably completely, and that the suction conduit system has at least one channel portion firmly connected to the port and at least one channel portion connected to the cover element, which are so designed that they jointly form a channel portion through which dust can be sucked off when the cover element is located in the covering position. In particular, the channel portions can be so configured that a suction of dust is possible through the channel portion firmly connected to the port and the channel portion connected to the cover element when the cover element is located in the covering position. This embodiment advantageously offers a high flexibility in the arrangement and configuration of the suction conduit system.

Further, a conduit portion can comprise a swiveling portion in which the suction opening is formed and which is moveable between a working position in which dust can be sucked from the transport path and a servicing position in which an apparatus element inaccessible in the working position through the swiveling portion is accessible.

The suction conduit system further needs to possess substantially only a conduit which has the different portions and whose one end is connected to the port or opens thereinto. However, it is also possible that the suction conduit system has branches which comprise the different portions.

In particular, in the method, the same suction unit for generating a negative pressure can be employed for sucking dust at the at least two places and sucking dust with the hand cleaning portion. For this purpose, the suction conduit system can, in the value document processing apparatus, have in particular a branch element connected to the port and having at least two branches, of which at least two branches one is connected to the hand cleaning portion and one to the at least two conduit portions, so that dust can be sucked through the hand cleaning portion and/or the at least two conduit portions and the port. This embodiment has the advantage that only one suction unit needs to be supplied. Furthermore, the servicing of the suction unit is simplified, because sucked-off dust that has been collected need only be removed from one suction unit or dust receiving device connected thereto.

Preferably, although the same suction unit is employed for sucking dust with the hand cleaning portion and the conduit portions, dust is, in the method, preferably not sucked through the hand cleaning portion while dust is being sucked at the places on the transport path. In the value document processing apparatus, the suction conduit system can thus preferably have a distributing device which is switchable back and forth at least between a hand cleaning position in which dust can be sucked through the hand cleaning portion and an operational cleaning position in which dust can be sucked through the at least two conduit portions. This has the advantage that a lower-power suction unit can be employed, in particular since upon normal operation a suction of dust through the hand cleaning portion is possible, but in some embodiments not absolutely necessary. As a distributing device there can be employed for example at least two series-connected valves or a two- or multiway valve.

For switching over the distributing device it is possible to use different variants, of which some will be described hereinafter and which can be employed alternatively or in combination.

In principle, the distributing device can be switched back and forth between the two positions by a user by hand. Further, the value document processing apparatus can contain at least one control device controllable by inputs of a user and emitting, upon corresponding inputs of the user, control signals to the distributing device, which has at least one drive controllable by the control signals, by means of which drive the distributing device is switchable back and forth between the two positions.

However, the switch-over can also be effected automatically in dependence on the state of the value document processing apparatus or parts of the same or change of the state. Thus, in the method, the housing can have a housing opening through which access is possible at least to the checking device, and a cover element for covering the housing opening, said cover element being movable between an open position in which access to the checking device is possible, and a covering position in which the housing opening is covered at least partly, preferably completely, and the suction of dust at the at least two different places on the transport path and/or through the hand cleaning portion be effected in dependence on the position and/or motion of the cover element between the open position and the covering position. In the value document processing apparatus, the housing can thus preferably have a housing opening through which access is possible at least to the checking device, and a cover element for covering the housing opening, said cover element being movable between an open position in which access to the checking device is possible, and a covering position in which the housing opening is covered at least partly, preferably completely, and the position of the distributing device can be, or have been, adjusted in dependence on the position of the cover element and/or a motion of the cover element between the open position and the covering position.

The switch-over of the distributing device can, however, also be performed in dependence on the state of the checking device. Thus, in the method, the checking device can have an optical sensor, preferably an optical sensor with a window facing the transport path, and be shiftable from an operating state in which a check of value documents is performable by the checking device, to a cleaning state in which the optical sensor, in particular the window of the optical sensor, is accessible, and back; then the suction of dust at the at least two different places on the transport path and/or through the hand cleaning portion can be effected in dependence on the state of the checking device and/or a change of the state of the checking device. In the value document processing apparatus, the checking device can then preferably have an optical sensor, preferably an optical sensor with a window facing the transport path, and be shiftable from an operating state in which a check of value documents is performable by the checking device, to a cleaning state in which the optical sensor, in particular the window of the optical sensor, is accessible, and back, further the position of the distributing device can be adjusted in dependence on the state of the checking device and/or a change of the state of the checking device, preferably automatically.

If suction is not intended at the transport path, the suction of dust can be effected, in the method, through the hand cleaning portion in dependence on the state of the checking device and/or a change of the state of the checking device arising from the position of the cover element and/or a motion of the cover element between the open position and the covering position, i.e. air with dust is only sucked through the hand cleaning portion upon a given state or a given position or a corresponding change. For the apparatus, this means that the distributing device is replaced by a valve which is arranged in the connection between the port and the hand cleaning portion and whose position is adjusted in dependence on the state of the checking device and/or a change of the state of the checking device arising from the position of the cover element and/or a motion of the cover element between the open position and the covering position, or that the port and the distributing device are replaced by a suction unit whose operating state has been adjusted in dependence on the state of the checking device and/or a change of the state of the checking device arising from the position of the cover element and/or a motion of the cover element between the open position and the covering position.

Hence, a dust suction through the hand cleaning portion is only switched on when the checking device assumes a state suitable therefor. This offers the advantage that the user does not need to input any special control signals, which in particular in the case of large value document processing apparatuses could require walking back and forth at the apparatus and thus time.

In particular, the adjustment of the distributing device can be so effected that there is effected either a suction through the hand cleaning portion, or a suction at the at least two places or through the at least two conduit portions.

For the automatic switch-over or adjustment, several possibilities are conceivable.

For example, there can be provided sensors which capture the state of the checking device and/or a change of the same and/or the position of the cover element and/or a change of the same, and emit corresponding sensor signals upon which the distributing device or the valve or suction unit is accordingly switched over or adjusted.

Thus, in a preferred embodiment of the value document processing apparatus, a drive controllable by a control device is provided for moving the cover element, and the control device controls both the drive and the distributing device. As mentioned above, the distributing device has in this case likewise a corresponding drive controllable by the control device, for switching over the distributing device. Accordingly, there can be provided, upon a switch-over in dependence on the state of the checking device, in the value document processing apparatus, a drive controllable by a control device, for changing the state of the checking device, and the control device controls both the drive and the distributing device.

These embodiments have the advantage that the respective drives can be configured independently of each other, and thus optimized for their respective function.

Alternatively, it can also be preferred, however, that, in the value document processing apparatus, a common drive source is provided for moving the cover element or for changing the state of the checking device and for changing the position of the distributor device. Said drive source coupled mechanically to the stated elements or devices can then be controlled by the above-mentioned control device controllable by a user by inputs, and/or by a control device which is controlled in dependence on the state of the transport device, in particular the presence of a jam.

In principle, the suction conduit system can also possess, as conduit portions, branches which lead to other functional units of the value document processing apparatus, for example to a singler. Preferably, however, the suction conduit system possesses only conduit portions that have suction openings for sucking dust but do not serve to supply other components of the value document processing apparatus. In particular, the value document processing apparatus can have the suction unit which is then particularly preferably connected only to the port and hence only sucks air through the suction conduit system.

BRIEF DESCRIPTION OF THE DRAWINGS

The invention will be explained further hereinafter by way of example with reference to the drawings. There are shown.

DETAILED DESCRIPTION OF VARIOUS EMBODIMENTS

Figure 1:
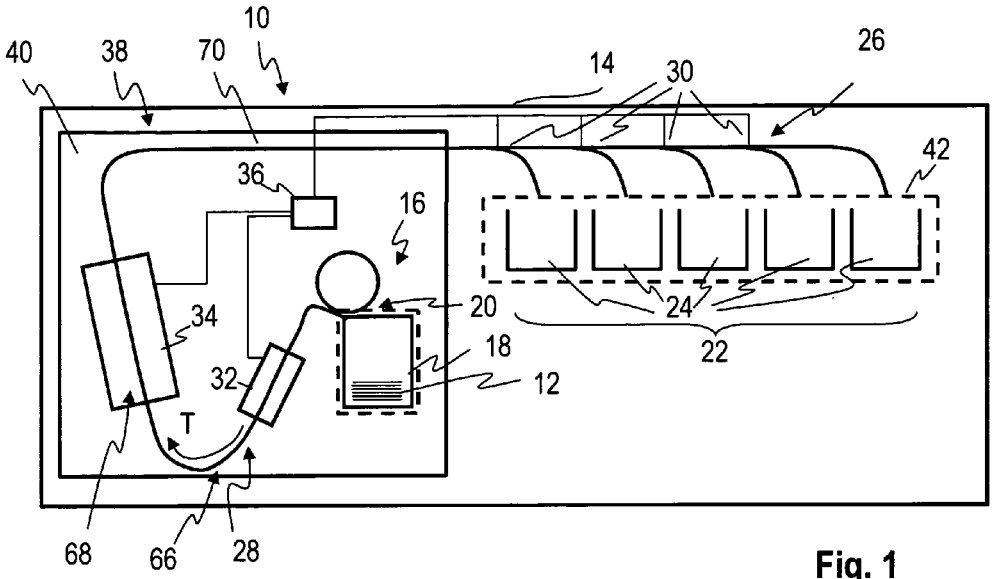
FIG. 1 a schematic view of a value document processing apparatus in the form of a bank-note sorting apparatus.

An apparatus 10 for processing value documents 12, in the example bank notes, in FIG. 1 possesses in a housing 14 an input or input unit 16, which is integrated with an input pocket 18 for receiving a stack of value documents 12 to be processed, and a singler 20 for singling the value documents 12 of the stack and emitting them as singled value documents, an output or output unit 22 with at least two, in the example five, storage pockets 24 for storing processed value documents 12, and a transport device 26 for transporting singled value documents 12 along a transport path 28 from the input unit 16 to the output unit 22. The transport device 26 has gates 30 by means of which branches of the transport path 28 to the storage pockets 24 are formed. At the end of the branches there are arranged in each case spiral pocket stackers, not shown in the figures, which deposit the value documents in the storage pockets 24. At the transport path 28 there are arranged a first checking device 32 and a second checking device 34 which captures, in particular physical, properties, for example their printed image and/or luminescence properties, of value documents 12 transported in singled form past them, and generates in dependence on the captured properties, on the basis of given criteria for the type, in particular the denomination, and/or the authenticity and/or the state of the value documents, signals which render or represent the type or the authenticity or the state of the particular checked value document. A control device 36 is connected via signal connections inter alia to the checking devices 32 and 34 and the transport device 26, and controls inter alia in dependence on the signals of the checking devices 32 and 34 the transport device 26, in particular the gates 30, such that the value documents are stored in corresponding storage pockets 24 according to the results of the check and any further criteria. The control device 36 has, not shown in the figures, a user interface for inputting and outputting data relating to the operation of the apparatus. The user interface can have for example a display device and a keyboard and/or a pointing device, for example a mouse, or a touch-sensitive display (touch screen).

The housing 14 has a housing opening 38 through which access is possible to the input 16, the checking devices 32 and 34 and corresponding parts of the transport path 28. The housing 14 further possesses a cover element 40, shown transparently in FIGS. 1 and 2 for clarity's sake, for covering the housing opening 38, said cover element being movable between an open position in which access to the checking devices 32 and 34 through the housing opening 38 is possible, and a covering position in which the housing opening 38 is covered at least partly, preferably completely. In this example, the cover element 40 is an upward swiveling hood hinged at its upper edge and having an opening 42 in the area of the input 16 for insertion of a stack of value documents.

The housing 14 has at least one further opening 42 for the output 22 through which value documents can be removed from the output 22. The housing 14 can also have further doors or flaps which make possible an access for example to parts of the transport path 28 which are not reachable through the housing opening 38.

The value document processing apparatus 10 further possesses (cf. FIGS. 2, 3 and 4) a suction conduit system 44 for suction air, which has a port 46 for a suction unit 48 for sucking air with dust out of the suction conduit system 44, and at least one hand cleaning portion 50 connected to the port and having a suction opening 52 movable in the area of the checking devices 32 and 34 relative thereto, and at least two, in the example five, conduit portions 54, 56, 58, 60 and 62 connected to the port 46. The suction unit 48 is shown within the apparatus 10 in FIG. 2 for clarity's sake, but is actually located outside the housing 14 in this embodiment example. In other embodiment examples, it can also be arranged within the housing 14 as part of the apparatus 10. The conduit portions have suction openings arranged at different portions of the transport path 28 and directed onto the transport path 28, through which dust is transportable from value documents 12 transported along the transport path 28.

Figure 2:
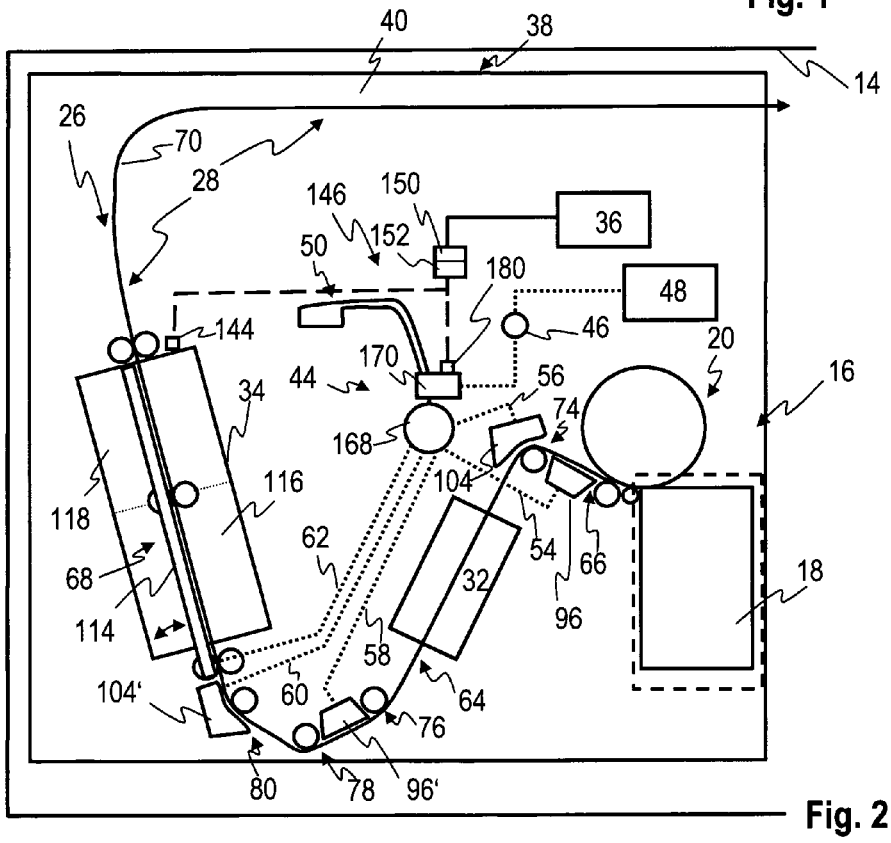
FIG. 2 a schematic enlarged representation of a part of the value document processing apparatus in FIG. 1, FIG. 3 a perspective representation of a part of a suction conduit system of the value document processing apparatus in FIG. 1 with guiding devices in the area of a transition from a singler to a transport device of the value document processing apparatus and in the area of bends in the transport path, FIG. 4 a perspective representation of a part of the suction conduit system of the value document processing apparatus in FIG. 1 with a swiveling portion in the area of a checking device of the value document processing apparatus in FIG. 1, FIG. 5 an enlarged side view of parts of a transport device of the value document processing apparatus in FIG. 1 and parts of the suction conduit system at the transition from the singler to the transport device, FIG. 6 an enlarged perspective view of a suction block of a first conduit portion of the suction conduit system, FIG. 7 an enlarged perspective view of a guiding device of a second conduit portion of the suction conduit system, FIG. 8 an enlarged side view of parts of a transport device of the value document processing apparatus in FIG. 1 and parts of the suction conduit system at bends of the transport path, FIG. 9 an enlarged perspective view of a suction block of a third conduit portion of the suction conduit system, FIG. 10 an enlarged perspective view of a guiding device of a second conduit portion of the suction conduit system, FIG. 11 a schematic side view of the second checking device and of a holding device therefor with the viewing direction against the transport direction in which the second checking device is located in an operating state, FIG. 12 a schematic plan view of the second checking device and the holding device, FIG. 13 a schematic side view of the second checking device and of a holding device as in FIG. 12, but with the second checking device located in a cleaning state, FIG. 14 a perspective view of a swiveling portion of a fifth conduit portion of the suction conduit system and of a guide plate of a holding device for sensors of the second checking device, FIG. 15 a schematic perspective view of a distributing device of the suction conduit system, FIG. 16 a view corresponding to FIG. 2, of a further embodiment example of a value document processing apparatus, and FIG. 17 a view corresponding to FIG. 2, of yet a further embodiment example of a value document processing apparatus.

The components of the value document processing apparatus 10 in the area of the housing opening 38 are illustrated more precisely, but schematically, in FIG. 2.

The transport device 26 has a first portion 64 which reaches from a transition point 66 at the singler 18 to the second checking device 34. Along the corresponding portion of the transport path 28, value documents are conveyed with a belt transport. For transport along the first portion 64, the transport device has driven belts 82 for transporting value documents emitted by the singler 18 in singled form. The first portion 64 is followed by a second portion 68 which extends up to the end of the second checking device 34, or somewhat therebeyond, and in which value documents are transported in belt-free fashion. For transport along the second portion 68, the transport device 26 has pairs of rollers in the area of the second checking device 34. The second portion 68 is followed by a third portion 70 which reaches up to the output 22 and is designed, like the first portion 64, for belt transport.

The transport path portion formed by the first portion 64 has after the transition point 66 from the singler four bent portions or bends 74, 76, 78 and 80, of which the bends 74, 76 and 78 can also be regarded as a bend or bent portion according to the invention.

Both at the transition point 66 and at the four bends 74, 76, 78 and 80, the transport device 26 has transport rollers 84, 86, 88, 90 and 92 over which in each case belts 82 for transporting the value documents are guided and of which at least some are driven. The rollers 86, 88, 90 and 92 act here as diverting rollers on which the value documents are steered in a new direction, which is effected here by deflection of the belts 82, but can also be effected in other embodiment examples by direct contact of the value documents with the diverting rollers.

Figure 13:
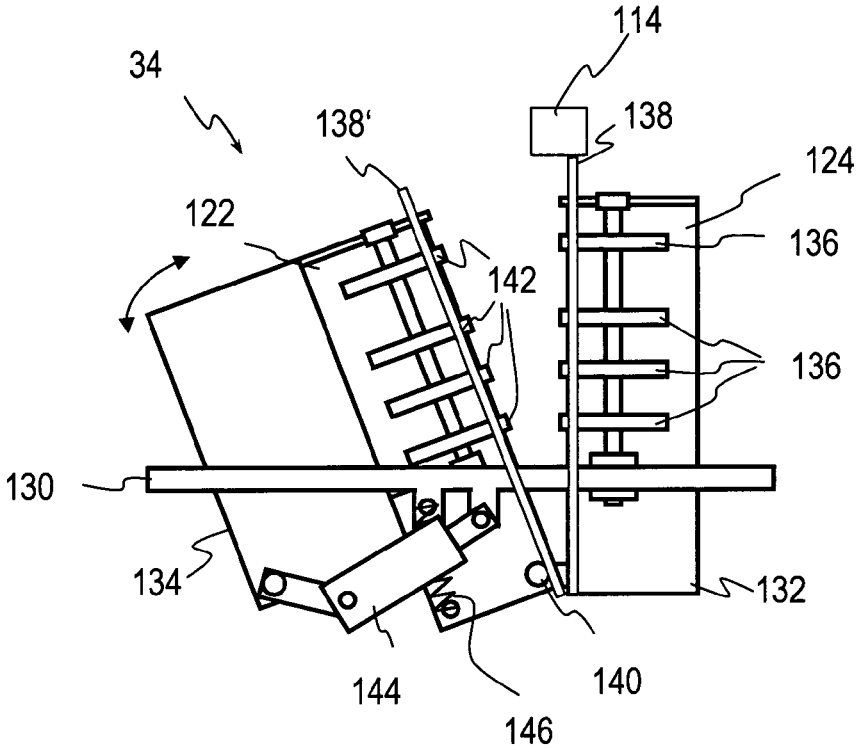

The transport device 26 has, in the second portion, partly driven transport rollers, shown only partly in FIG. 13, which transport the value documents in beltless fashion.

For sucking off air and thus dust from the value documents and in the air in the area of the transport path 28 there serve the conduit portions 54 to 62, which will be described more precisely hereinafter.

The conduit suction openings of the first two conduit portions 54 and 56 and the conduit suction openings of the third and the fourth conduit portions 58 and 60 are so arranged that air and thus dust is sucked from two different sides of a value document transported along the transport path.

Figure 5:
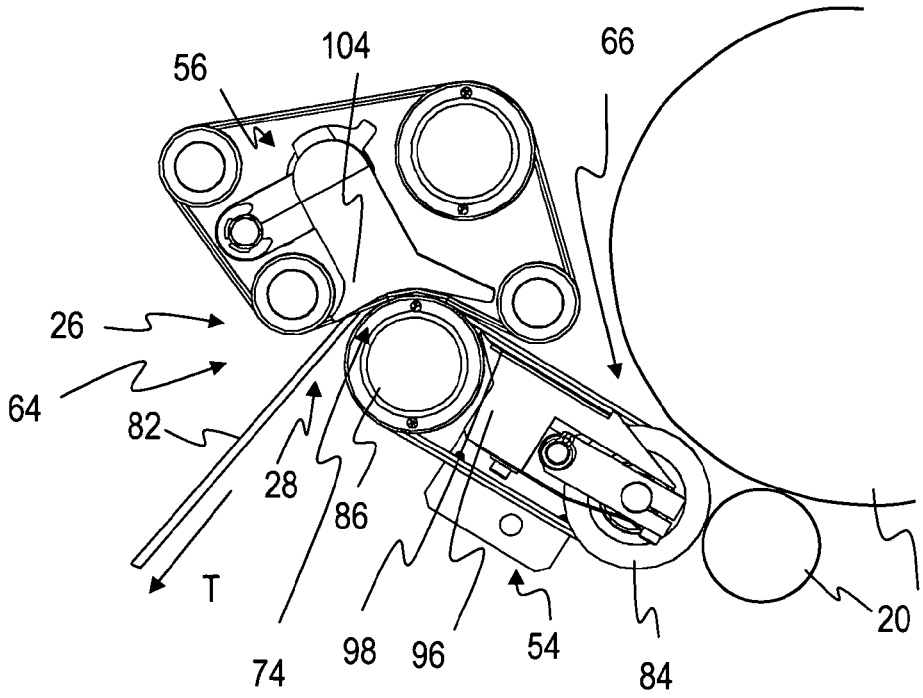
Figure 6:
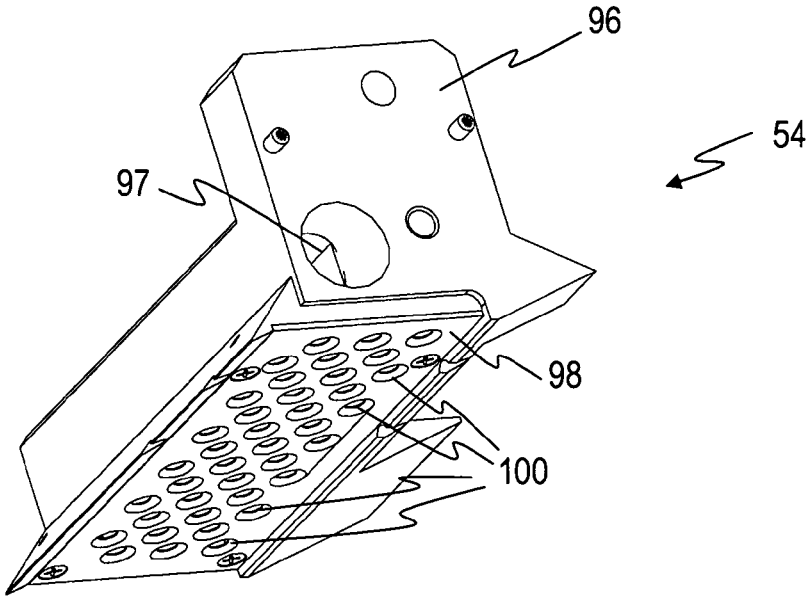
Figure 7:
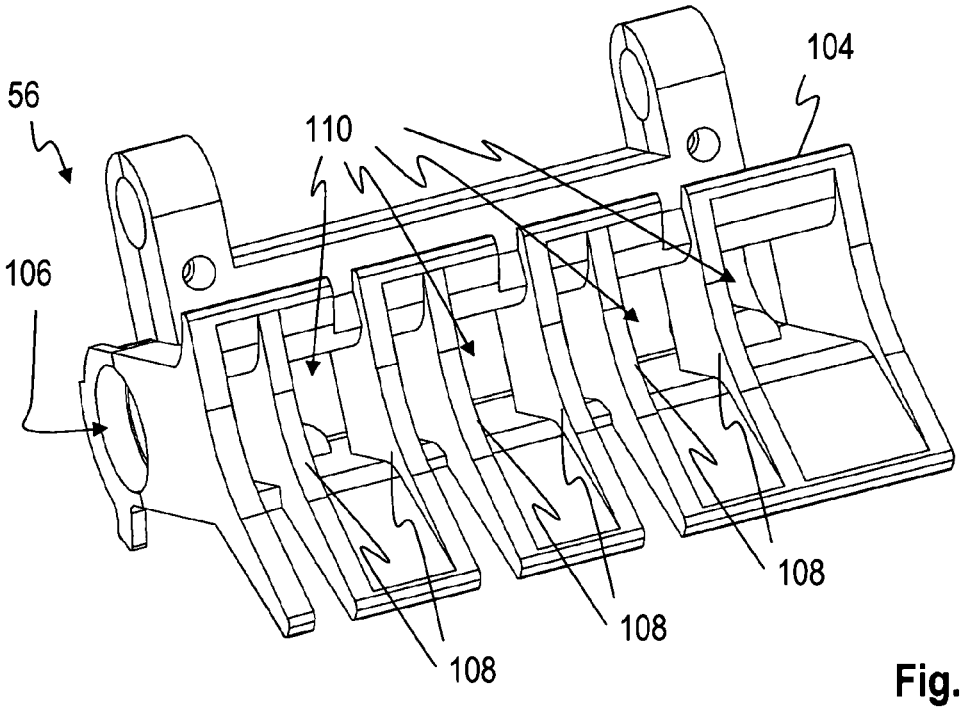

As shown more precisely in FIGS. 5 to 7, the first conduit portion 54 has a tube 94 and at its end a first suction block 96 in which there is formed a hollow space 97 connected to the end of the tube 94 and closed in the direction of the transport path by a plate 98 with suction openings 100 directed onto the transport path 28 and arranged perpendicular to the transport direction T, in this example staggered or in rows.

The first suction block 96 and thus the suction openings 100 are arranged between the rollers 84 and 86 in the area of the transition point 66 between singler 18 and transport device 26. This permits the suction of dust which can arise upon singling and upon the subsequent transition to the transport device 26. Through the arrangement of the suction openings 100 across substantially the total width of the transport path there can furthermore be effected a suction over the total surface of the value document.

The second conduit portion 56 likewise has a tube 102 and at its end a guiding device, in the form of a first guiding block 104, arranged at the bend 74. The guiding block 104 has a channel 106 connected to the end of the tube 102, and, at its side facing the transport path 28 or the diverting roller 86, ribs 108 extending in the transport direction and arranged perpendicular thereto, between which ribs the channel 106 opens into suction openings 110 arranged perpendicular to the transport direction and directed onto the transport path. In the present embodiment example, however, the guiding device 104 guides parts of a value document only when they protrude beyond the transport belts, and thus prevents impairments of the transport. The actual deflection is effected through the belts 82.

Through the arrangement of the suction openings 110 in the area of the bent portion 74, dust detached through the deformation of the value document effected upon deflection, and dust rubbed off through slip of the belts, can already be sucked off as it arises and, hence, is not distributed, or in any case not as much, in the housing 14, in particular into the area of the checking devices 32 and in particular also 34.

Figure 8:
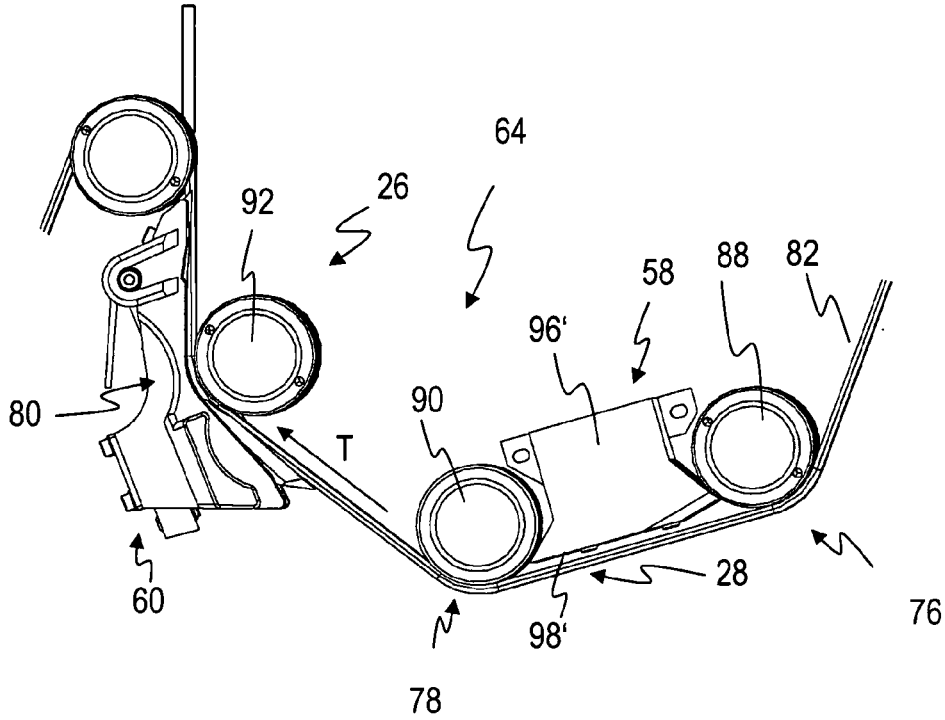
Figure 9:
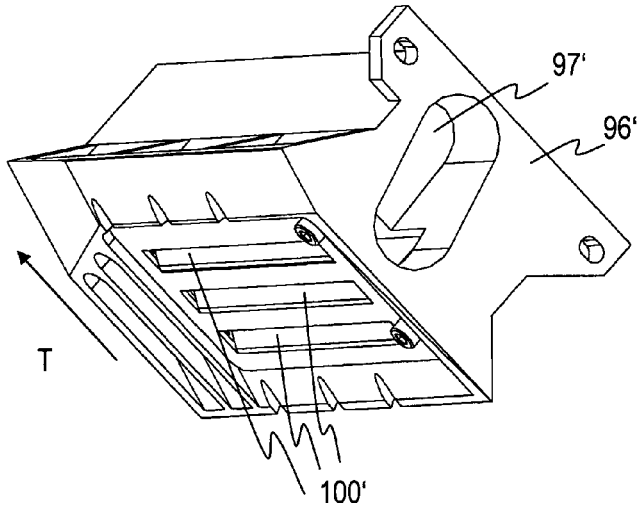

The third conduit portion 58 illustrated more precisely in FIGS. 8 and 9 is constructed in principle like the first conduit portion 54 and likewise has a tube 94' and a second suction block 96' arranged at its end, in which there is formed a hollow space 97' connected to the end of the tube 94' and closed in the direction of the transport path by a plate 98' with suction openings 100' directed onto the transport path 28. However, the suction openings 100' are of slot-shaped configuration in contrast to the circular suction openings 100, whereby the slots extend with their longer side perpendicular to the transport direction and are arranged one behind the other in the transport direction.

The second suction block 96' and thus the suction openings 100' are arranged between the diverting rollers 88 and 90 in the area between the bent portions or bends 76 and 78. This permits the suction of dust that has resulted through the further transport after the diverting roller 86.

Figure 10:
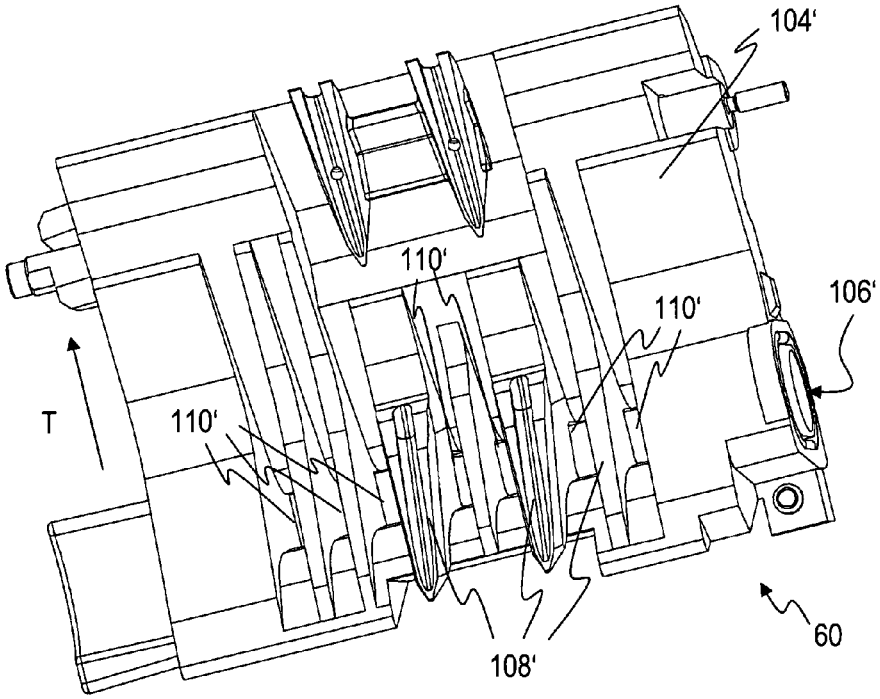

The fourth conduit portion 60 illustrated more precisely in FIGS. 8 and 10 is constructed similarly to the second conduit portion 56 and likewise has a tube 102' and a guiding device, in the form of a second guiding block 104', arranged at the bent portion or the bend 80. The guiding block 104' also has a channel 106' connected to the end of the tube 102', and, at its side facing the transport path 28 or the diverting roller 92, ribs 108' extending in the transport direction, between which ribs the channel 106' opens into suction openings 110', which are directed onto the transport path 28 but arranged side by side perpendicular thereto. In the present embodiment example, however, the guiding device guides parts of a value document in the above only when they protrude beyond the transport belts, and thus prevents impairments of the transport. The actual deflection is effected here, too, through the belts 82.

The suction openings 100, 100', 110, 110' are preferably arranged less than 20 mm away from the plane of the transport path 28.

The fifth conduit portion 62 (cf. FIG. 14) has a tube 112 and a swiveling portion 114 which is adapted to swivel around one end of the tube 112, and for sucking air and dust located therein at the transition from the first transport portion 64 for belt transport to the second transport portion 68 for beltless transport and along the second checking device 34.

Figure 11:
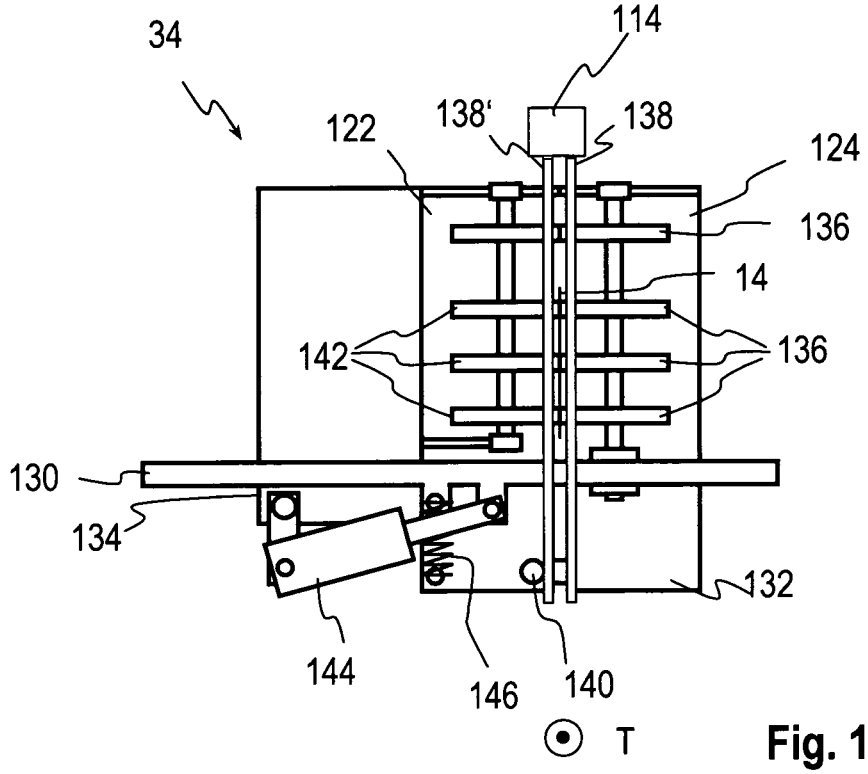
Figure 12:
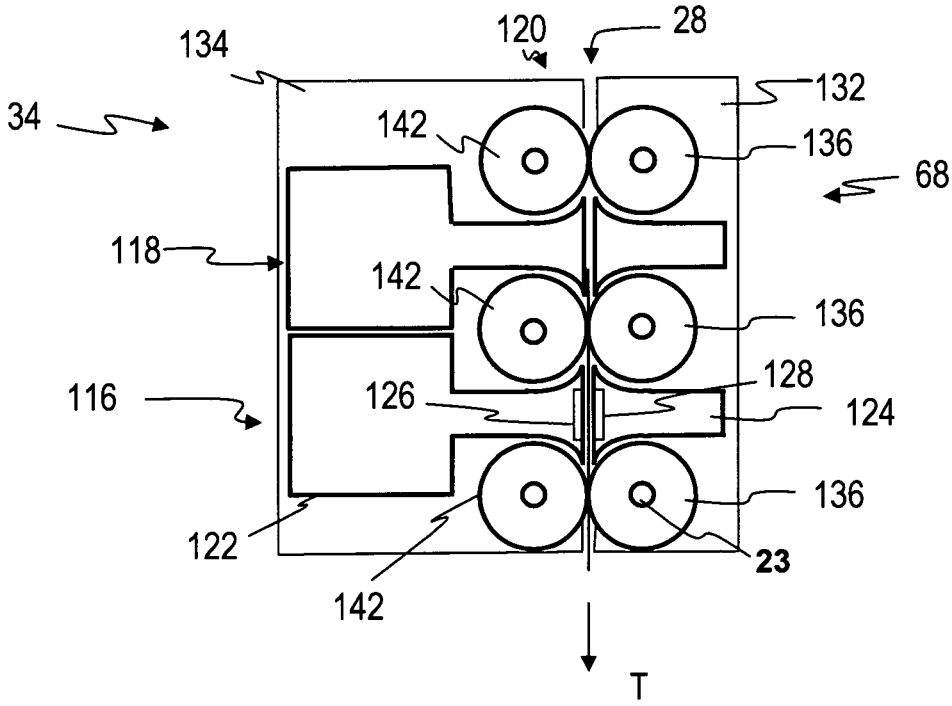

FIGS. 11 to 13 show in schematically simplified form the second checking device 34 with a two-part optical sensor 116 and a two-part ultrasonic transmission sensor 118 as well as a holding device 120 for the second checking device 34 and parts of the second portion 68 of the transport device 26. While FIG. 11 shows the area of the checking device 34 in a side view, in the transport direction of the transport device 26, the same area is depicted in FIG. 12 rotated 90° around an axis perpendicular to the transport direction. By way of example, the optical sensor 116 has two parts 122 and 124 which are arranged on opposing sides of the transport path. The part 122 serves, on the one hand, for remission measurement and thus possesses an illumination device for illuminating a value document with optical illumination radiation and a detection device for detecting optical radiation which emanates from a value document illuminated with the illumination radiation. The parts 122 and 124 serve for transmission measurement, whereby the part 124 comprises a detection device for detecting illumination radiation of the part 122 which has passed through a value document. For protection of the illumination device and the detection devices from soiling by dust, they are arranged in respective sensor housings which respectively have windows 126 and 128 directed onto the transport path 28; the windows are so configured and arranged that both the illumination radiation and the detection radiation can pass through the window 126 or the transmitted illumination radiation through the window 128. The optical sensor 116 scans line by line a value document transported past it, so that an image of the value document is present after it has been transported past. To guarantee proper functioning of the sensor, it is necessary that the windows 126 and 128 are not, or only negligibly, soiled. Likewise, the surfaces facing the value document on the parts of the ultrasonic transmission sensor 118 that are arranged on both sides of the transport path 28 should not be soiled by dust if possible, in order to guarantee optimal functioning.

The second checking device 34 and the holding device 120 are so constructed that the checking device 34, in particular also for cleaning purposes, is shiftable from an operating state in which a check of value documents is performable by the second checking device 34, to a cleaning state in which the optical sensor 116, in particular the windows 126 and 128 of the optical sensor 116, are accessible, and back.

Thus, the holding device 120 is fastened to a stationary frame or a stationary plate 130 in the apparatus for processing bank notes 10; it possesses at least two parts, namely a first part 132 firmly connected to the plate 130 and as the second part a swivel mount 134.

The first part 132 possesses receiving means for the sensors, i.e. in particular a receiving means for the second sensor part 124, and along the transport path 28 at least two, preferably at least three, rollers 136 of the second portion 68 of the transport device 26 which are driven by a drive not shown, for example an electric motor and optionally a belt drive and/or gear train, the axis of said rollers extending substantially orthogonally to the transport direction and parallel to the longer side of the window 128 or the line direction of the detection device of the second sensor part 124. The first part 132 further has a guide plate 138, omitted in FIG. 12 for clarity's sake, on which value documents transported past can be guided on one side of the transport path 28. The guide plate 138 possesses openings in the area of the sensors, so that the guide plate 138 does not impair their function, and openings through which the driven rollers 136 reach. Said openings are not shown in FIG. 14, however.

The second part, i.e. the swivel mount 134, is hinged to the first part 132 around an axis 140. Like the first part 132, the swivel mount possesses receiving means for the sensors, i.e. in particular a receiving means for the first sensor part 122, and rollers 142 of the second portion 68 of the transport device 26, whose number corresponds to that of the driven rollers 136 and whose rotation axis extends substantially orthogonally to the transport direction and parallel to the longer side of the window 128 or the line direction of the detection device of the second sensor part 124.

The swivel mount 132 also has a guide plate 138', omitted in FIG. 12 for clarity's sake, on which value documents transported past can be guided on the other side of the transport path 28. The guide plate 138' possesses openings in the area of the sensors, so that the guide plate 138' does not impair their function, and openings through which the rollers 142 can reach.

The swivel mount 134 allows the second checking device 34 to be shifted to the two above-mentioned states.

In the operating state in FIG. 11, the swivel mount 134 is so aligned relative to the first part 132 that sensors of the checking device 34 assume a position, relative to each other and to the transport path 28, in which they can capture properties along the transport path 28 of transported value documents and thus a check of value documents is performable. Further, the guide plates 138 and 138' are arranged at least approximately parallel to each other and form a narrow guiding gap for the value documents. Further, the driven rollers 136 and the rollers 142 are so aligned relative to each other that they pinch a value document coming from the first portion 66 of the transport device 26 and transport it further, acting as a roller transport, along the transport path 28. Hence, the rollers 136 and 142 form pairs of rollers for a beltless transport along the transport path portion formed by the second portion 68 of the transport device 26. To be able to guarantee the transport of the value documents, the distance between the rotation axes of consecutive pairs of rollers 136, 142 along the transport path 28, regarded in the transport direction, must be smaller than the dimension of the smallest value document in the direction of which dimension the transport of the value documents is effected in the transport system. When the value documents are transported parallel to their short edges (crosswise), the distance must not be greater than the width of the smallest value document to be transported. When the value documents are transported parallel to their long edges (lengthwise), the distance must not be greater than the length of the smallest value document. Advantageously, the distance between the rotation axes amounts to approximately half the width or length of the value document that is smallest in the corresponding direction.

In the cleaning state in FIG. 13, the swivel mount 134 is swiveled away from the first part 132 such that the sensors, for example the optical sensor 116, in particular its windows 126 and 128, are accessible for cleaning.

For moving the swivel mount 134 and thus for changing the state of the second checking device 34 there is provided an actuator, in the present example a pneumatic cylinder 144 of a pneumatic system 146 of the apparatus 10, whose one end is coupled rotatably to the plate 130 (or in another embodiment example to the first part 132) and whose other end is coupled rotatably to the swivel mount 134. Changes of pressure in the pneumatic system 146 cause the distance between the ends of the pneumatic cylinder to change, so that the swivel mount 132 is adapted to swivel through the eccentric linking to the swivel mount.

For compensating the weight of the swivel mount 134 with the sensor parts there is present a spring 148 whose one end is coupled eccentrically to the swivel mount 132 and whose other end is coupled to the frame or the plate 130. In the operating position depicted in FIG. 11 the spring 148 is tensioned only slightly, but it is tensioned strongly in the cleaning position in FIG. 13.

The pneumatic system 146 (cf. FIG. 2) can comprise in particular a pressure source 150, for example a pump, and/or a controllable valve 152 connected to the, or a, pressure source via a pressure line, as well as at least one connecting line to the pneumatic cylinder 144. For controlling the motion of the pneumatic cylinder 144, the control device 36 can control the pneumatic system, for example the pressure source and/or the valve 152, to change the pressure in the pneumatic system. By inputting corresponding instructions to the control device 36 a user can thus operate the pneumatic system. It is also possible, however, that the control device 36 is configured for recognizing by means of corresponding transport sensors of the transport device a transport malfunction upon transport of value documents to be processed, and for switching off the transport device in dependence on the recognition of a transport malfunction, and changing the state of the second checking device from the operating state to the cleaning state.

Figure 14:
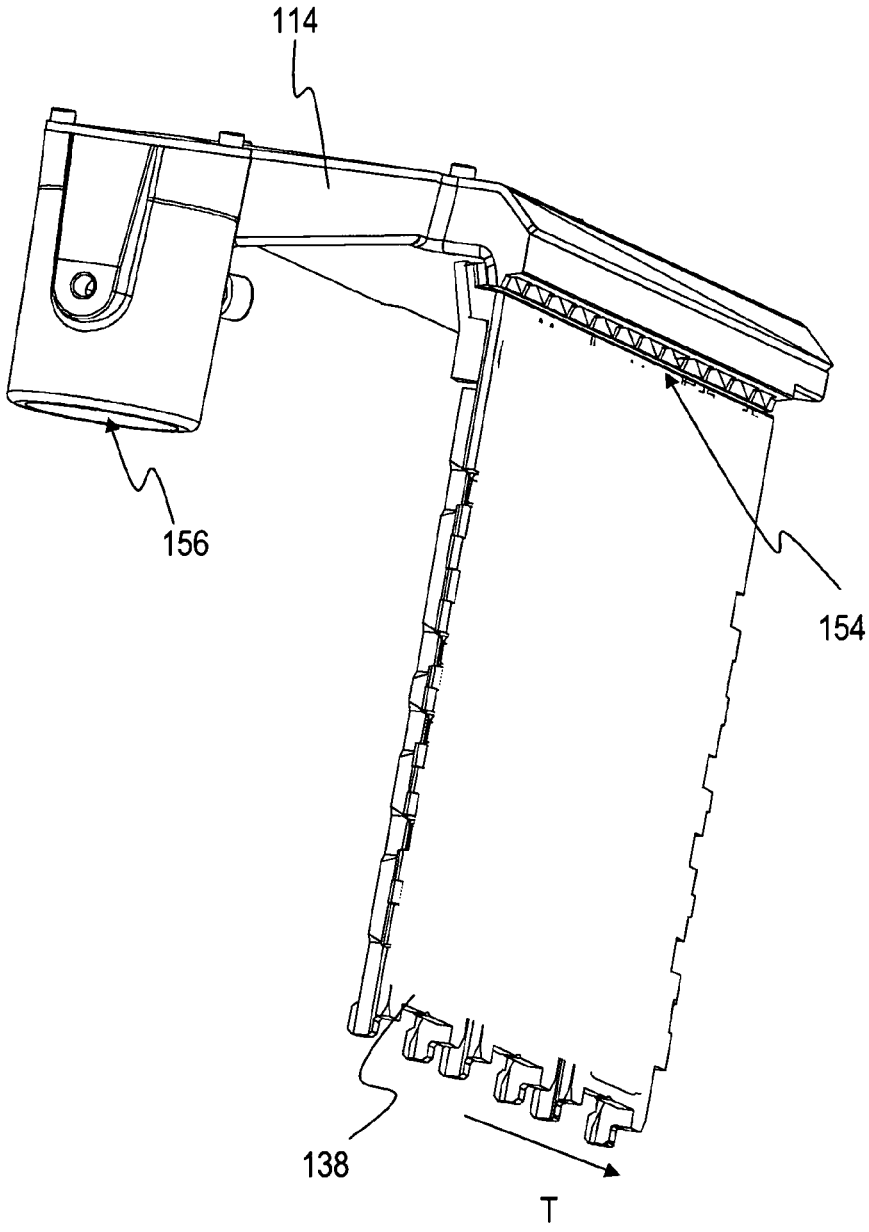

For sucking dust out of the area of the transition from the first to the second transport device portions, out of the area of the beltlessly working second portion of the transport device or the area of the second checking device, there is provided the fifth conduit portion 62, shown partly in FIG. 14, which has the tube 112 and the swiveling portion or swivel arm 114 with a slot-shaped suction opening 154 subdivided by ribs. One end of the tube 112 is connected to the port 46, the other end is configured as a socket onto which there is slipped the swiveling portion or swivel arm 114 with an opening 156 which is connected via a channel portion, not shown more precisely, in the suction opening 154. The upper edges of the guide plates 138 and 138' and the suction opening 154 are so configured that the edges close largely tightly with the swiveling portion, so that air sucked off through the suction opening 154, or dust sucked off with the air therethrough, comes mainly, preferably substantially completely, out of the area between the guide plates 138 and 138'.

During operation, or when the second checking device 34 is located in its operating state, the swiveling portion 114 is so adjusted that the suction opening 154 is arranged with its longer side parallel to the transport direction, preferably very close, above the guide slot formed by the guide plates 138 and 138'. In this manner, air, and in particular dust located in the air, can be sucked out of the area of the second portion 68 of the transport device 26 and the area of the second checking device 34, in particular of the windows 126 and 128 parallel to the plane of the value documents.

When the second checking device 34 is shifted to the cleaning state, i.e. swung open here, the swiveling portion 114 can be swiveled, in a plane parallel to the transport path and perpendicular to the plane of the value documents in the second portion 68 of the transport device 26 perpendicular to the direction of the line of the sensor 116, so far to the side that the second checking device 34, more precisely its windows 126 and 128, are accessible for cleaning purposes.

Figure 3:
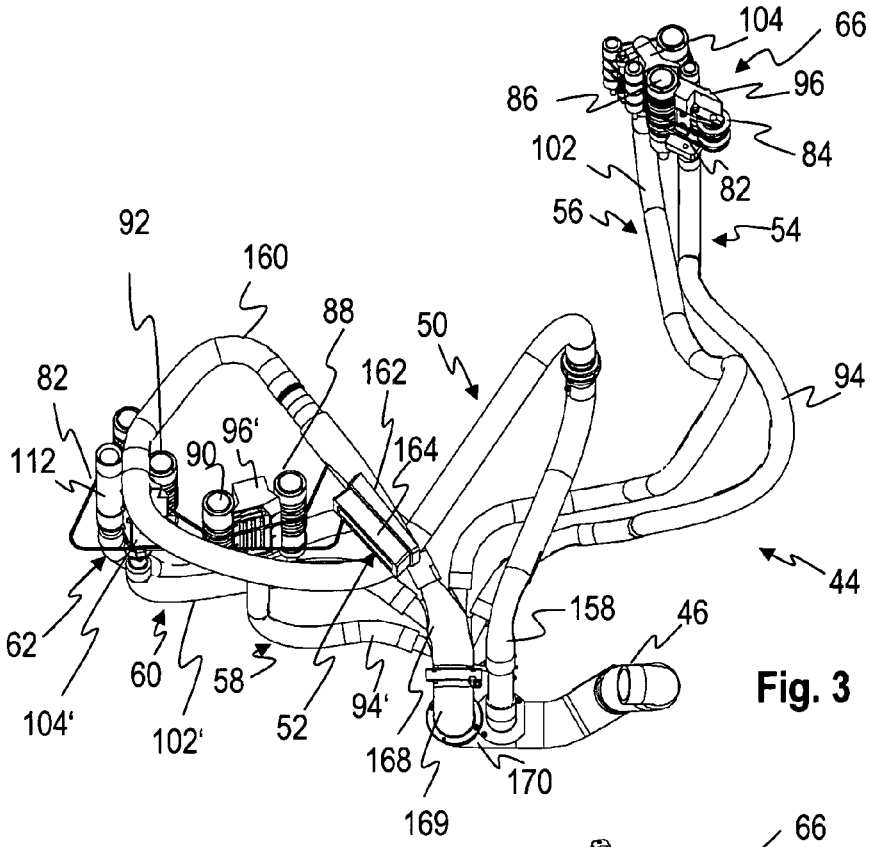
Figure 4:
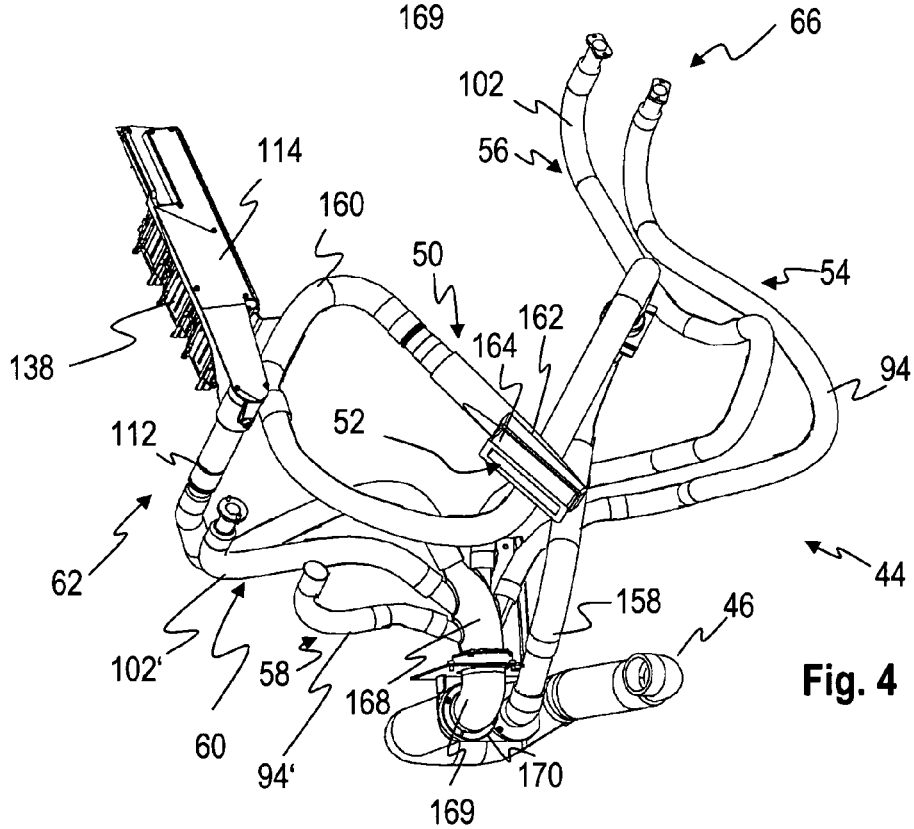

The suction conduit system 44 which is partly shown in FIGS. 3 and 4 has, besides the conduit portions, further the hand cleaning portion 44 which possesses a tube 158, a flexible hose 160 attached to the tube 158, and a suction brush 162 movable at the free end of the hose 160 into the area of the second checking device 34, said brush having a suction opening 52 surrounded by bristles 164. Since the suction brush 162 and thus the suction opening 52 is movable into the area of the second checking device 34, it can be used very well for sucking dust out of the area of the second checking device 34 or from the latter.

The connection of the five conduit portions 54 to 62 and of the hand cleaning portion 44 to the port 46 is effected as follows (cf. FIGS. 3, 4 and 15).

The five conduit portions 54 to 62 open into a branch element 168 which merges the branches in a tube portion 169.

For distributing the negative pressure from the suction unit 48, the suction conduit system 44 has a distributing device 170 (cf. FIG. 15) connected to the port 46, to the hand cleaning portion 50 and—in this embodiment example via the branch element 168—to the conduit portions 54 to 62, which is switchable back and forth at least between a hand cleaning position in which dust can be sucked through the hand cleaning portion 50 and an operational cleaning position in which dust can be sucked through at least two conduit portions, here the five conduit portions 54 to 64.

In this embodiment example, the apparatus 10 is so constructed that the position of the distributing device 170 is adjusted in dependence on the state of the second checking device 34 and/or a change of the state of the second checking device 34. In particular, the adjustment is effected in such a way that the distributing device 170 is shifted to the hand cleaning position when the second checking device 34 is shifted to the cleaning state, while the distributing device 170 is shifted to the operational cleaning position when the second checking device assumes its operating state or is shifted thereto.

In the present embodiment example, the distributing device 170 is thus so configured that a common drive source serves to change the state of the second checking device 34 and to change the position of the distributing device 170.

Figure 15:
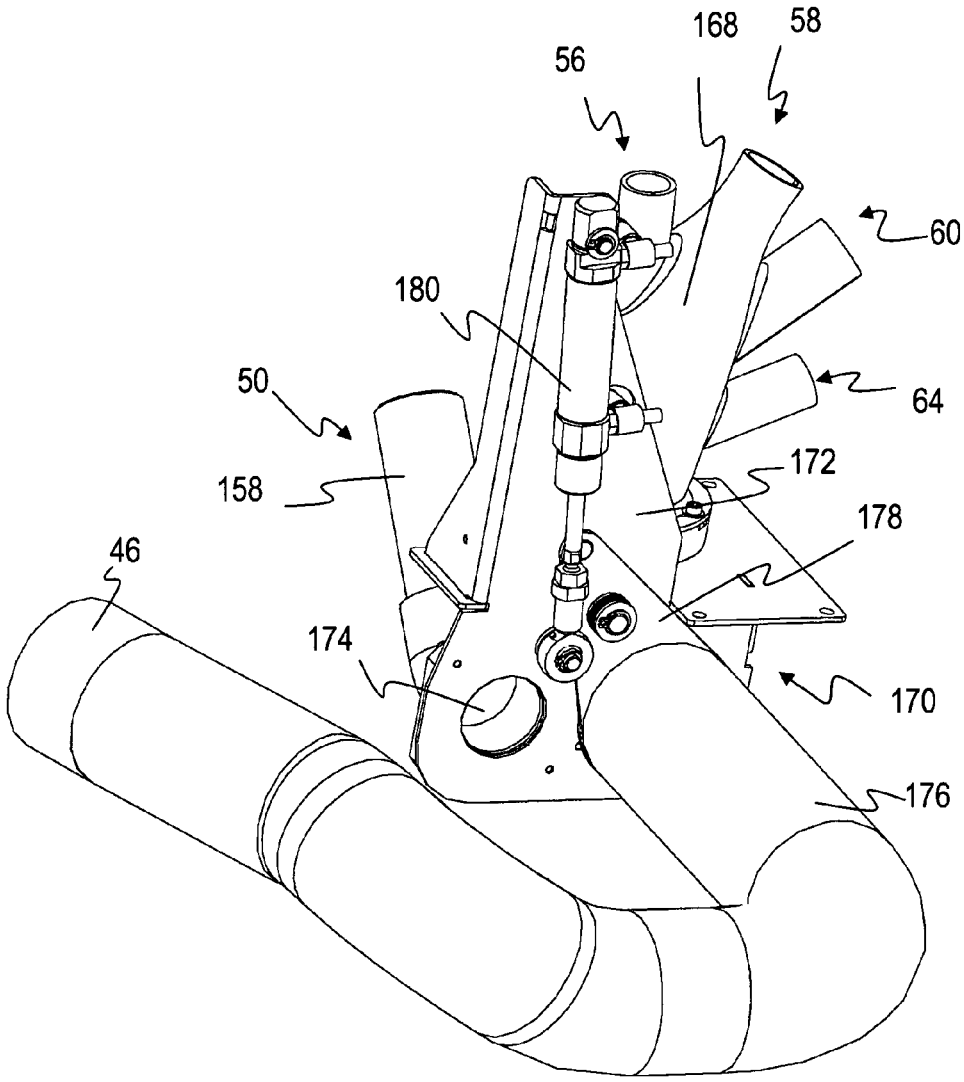

The distributing device 170 shown more precisely in FIG. 15 thus has a flange plate 172 in which there are formed two openings of which, in FIG. 15, one is hidden and the other is designated with the reference sign 174. The branch element 168, more precisely its tube portion 169, and the end of the tube 158 of the hand cleaning portion 50 are so connected to the distributing device 170, more precisely its flange plate 172, that they respectively open into one of the openings in the flange plate. For connection to the port 46 or the suction unit 48 there serves a flexible hose 176 whose one end is connected to the port 46 and whose other end is connected to a movable flange element 178. In FIG. 15 only the opening 174 to the hand cleaning portion 50 is visible, while the other opening connected to the branch element 168 is hidden by the flange element 178 and the hose 176 held thereon.

The flange element 178 is swivel-mounted on the flange plate 172 slidingly with its flange surface on the flange surface of the flange plate 172 such that it is capable of being swiveled back and forth between a position shown in FIG. 15 in which it connects the end of the hose 176 to the branch element 168, preferably tightly in the range of the employed negative pressures, and a position in which it connects the end of the hose 176 to the end of the hand cleaning portion 50, preferably tightly in the range of the employed negative pressures.

For swiveling there is provided as a common drive source the pneumatic system 146, which has a further pneumatic cylinder 180 and which is supplied with pressure by means of the pressure source 150. Said cylinder is connected at one end rotatably to the flange plate 172 and its slide or other end, movable by the pressure, eccen-trically to the swiveling flange element 178.

Thus, when the pressure in the pneumatic system is increased there are shifted at the same time the second checking device 34 from the operating state to the cleaning state, and the distributing device 170 from the operational cleaning position shown in FIG. 15 to the hand cleaning position. Conversely, upon a pressure drop there are shifted at the same time the second checking device 34 from the cleaning state to the operating state, and the distributing device 170 from the hand cleaning position to the operational cleaning position.

Thus, when a user performs on the control device 36 an input upon which the control device 36 shifts the second checking device 34 from the operating state to the cleaning state, in this example by controlling the pressure source of the pneumatic system 146 such that it increases the pressure, the second checking device 34 is automatically shifted to the open cleaning state and air sucked through the hand cleaning portion. Thus, a thorough cleaning of the second checking device 34 and the surroundings of the device can be easily effected by the suction brush 162 being guided suitably by a user.

In the hand cleaning position, a suction is thus effected only through the hand cleaning portion 50, in the operational cleaning position only through the conduit portions 54 to 62.

Figure 16:
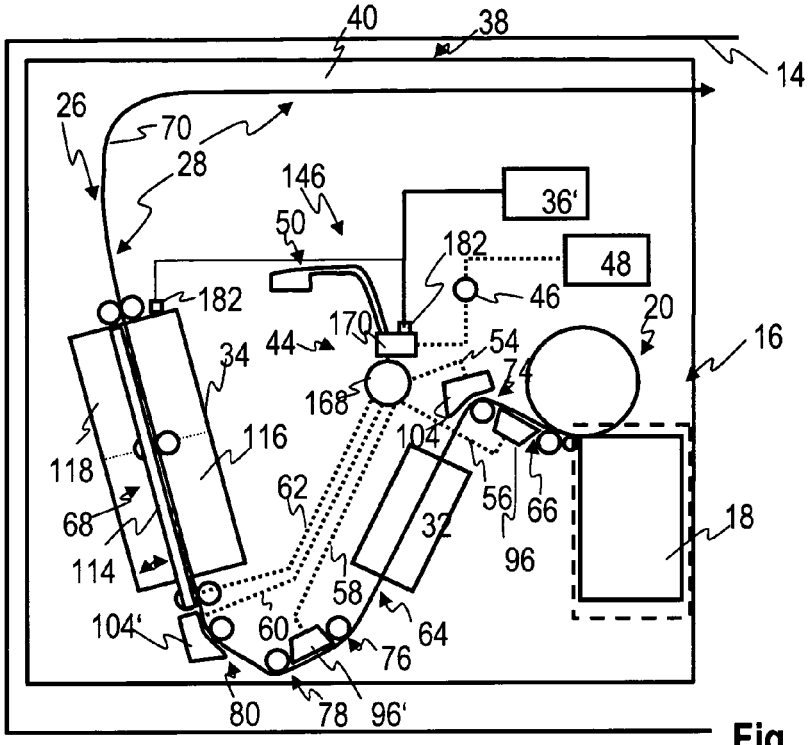

A second embodiment example in FIG. 16 differs from the first embodiment example only in that the distributing device 170 and the second checking device 34 are driven differently and, hence, the control device is also modified. All the other parts of the apparatus are unchanged, so that the same reference signs are employed therefor and the comments thereon for the first embodiment example apply here, too.

Instead of the pneumatic system with the pneumatic cylinders there are now provided separate drives 182, for example electric motors, for changing the state of the second checking device 34 and the position of the distributing device 170. They are connected via control connections to the control device 36' and are controllable thereby. The control device 36' differs from the control device 36 only in that it now controls, not the pressure source of the pneumatic system, but rather the drives jointly, so that the same function is achieved as in the first embodiment example.

Figure 17:
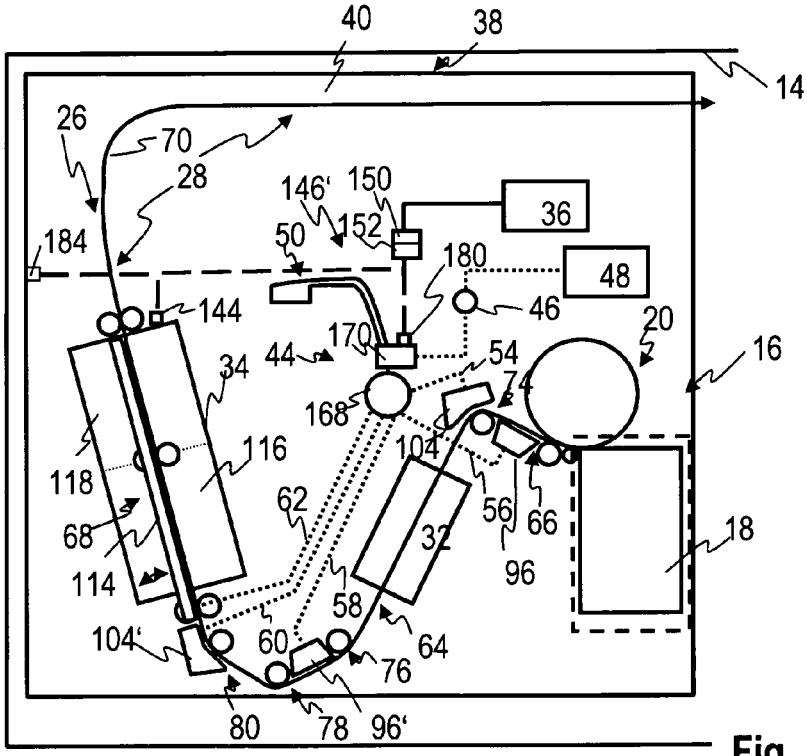

A third embodiment example in FIG. 17 differs from the first embodiment example only in that the switching on of the suction through the hand cleaning portion 50, more precisely the adjustment of the position of the distributing device, is effected, not in dependence on the state of the second checking device 34, but rather on the position of the cover element and/or a motion of the cover element between the open position and the covering position.

Thus, there is provided in the present embodiment example a common drive source for moving the cover element and for changing the position of the distributor device. Thus only the pneumatic system is changed relative to the first embodiment example, so that the same reference signs are also employed for the same components as in the first embodiment example and the comments thereon apply here, too. The pneumatic system 146" differs from the pneumatic system 146 only in that it has a further pneumatic cylinder 184 whose one end is coupled to the housing 14 and whose other end to the cover element 40. Through a corresponding input to the control device 36 a user can now, through corresponding control of the pneumatic system 146' by means of the control device 36, at the same time change the state of the second checking device 34, move the cover element 40 between its two positions, and switch on or off a suction through the hand cleaning portion or switch off or on a suction through the conduit portions.

In this connection, the further pneumatic cylinder 184 is coupled to the cover element 40 such that upon motion of the cover element 40 to the open position the state of the second checking device is changed to the cleaning state and the suction by means of the conduit portions is switched to suction by means of the hand cleaning portion. Upon motion of the cover element 40 in the other direction the reverse changes of the state of the checking device 34 and the suction system are effected.

Yet a further embodiment example differs from the preceding embodiment example in that a drive controllable by a control device is provided for moving the cover element, and that the control device is changed to the effect that it controls both the drive and the distributing device. All the other parts of the apparatus are unchanged relative to the preceding embodiment example, so that the same reference signs are employed for said unchanged parts and the comments apply accordingly here, too.

For moving the cover element 40 there is now provided as a drive an electric motor which can be controlled so as to move the cover element 40 back and forth between the stated positions by means of a gear and a coupling element. Hence, the pneumatic system 146' is replaced by the pneumatic system of the first embodiment example.

The control device differs from the control device of the preceding embodiment example in that it is configured for controlling the drive for the cover element 40, and in particular controls the drive for the cover element 40 and the pneumatic system 146 upon corresponding inputs of a user, thereby causing common changes of the position of the cover element 40, of the state of the second checking device 34 and of the position of the distributing device 170, so that altogether the same function is achieved as in the preceding embodiment example.

In yet other embodiment examples, at least one of the conduit portions can have several suction openings which are arranged on opposing sides of the transport path. For example, two guiding devices having the structure of the guiding device 104 could be arranged on opposing sides of the transport path and be connected to the same tube of the corresponding conduit portion. Thus there can be effected a simultaneous suction of dust on opposing sides of a value document.

In further embodiment examples, at least one of the tubes of the suction conduit system can also be replaced wholly or partly by a hose or a channel. In particular, it is conceivable that a part of such a channel is also formed by a part of a base plate or of the housing 14.

Yet a further embodiment example differs from the second embodiment ex-ample in FIG. 16 in that only the hand cleaning portion is included in the apparatus, so that the distributing device is omitted. The control device is now configured for switching on the suction unit when it shifts the second checking device to the cleaning state, and for switching it off again when it shifts the second checking device to the operating state.

The invention claimed is:

1. A value document processing apparatus comprising:

an input for value documents to be processed, an output and/or a storage device for processed value documents, a transport device for singled transport of value documents from the input along a transport path to the output or the storage device, a housing, a checking device arranged in the housing for checking value documents transported in singled form past it, and a suction conduit system for suction air, including a port for communication with a suction unit for sucking air with dust out of the suction conduit system, and at least one hand cleaning portion connected to the port and having a hand cleaning suction opening movable in the area of the checking device relative thereto.

2. The value document processing apparatus according to claim 1, wherein the hand cleaning portion has a flexible conduit part at a free end of which there is arranged a suction brush having the hand cleaning suction opening.

3. A value document processing apparatus comprising:

an input for value documents to be processed, an output and/or a storage device for processed value documents, a transport device for singled transport of value documents from the input along a transport path to the output or the storage device, a housing, a checking device arranged in the housing for checking value documents transported in singled form past it, and a suction conduit system for suction air, including a port for communication with a suction unit for sucking air with dust out of the suction conduit system, and at least one hand cleaning portion connected to the port and having a hand cleaning suction opening movable in the area of the checking device relative thereto, and/or at least two conduit portions connected to the port, each of the at least two conduit portions having at least one conduit suction opening arranged at different portions of the transport path and directed onto the transport path, through which openings dust is transportable from value documents transported along the transport path, wherein the conduit suction openings of the at least two conduit portions or wherein one of the at least two conduit portions having at least two conduit suction openings are so arranged that dust is sucked from two different sides of a value document.

4. The value document processing apparatus according to claim 3, wherein at least one of at least two conduit portions has altogether several conduit suction openings which are arranged perpendicular to the transport direction of the value documents.

5. The value document processing apparatus according to claim 3, wherein the input has a singling device for singling value documents of a stack of value documents to be processed and transferring them to the transport device, and wherein at least one conduit suction opening of at least one of the conduit portions is arranged at the singler and/or at a transition point between the singler and the transport device.

6. The value document processing apparatus according to claim 3, wherein the transport path has a bent portion, and at least one conduit suction opening of one of the conduit portions is arranged at the bent portion.

7. The value document processing apparatus according to claim 3, wherein the transport device has at least one diverting roller at which the direction of the transport path is changed, and wherein at least one conduit suction opening of the at least one conduit portion is arranged at the diverting roller.

8. The value document processing apparatus according to claim 3, wherein the transport path has two consecutive bent portions, or the transport device has two consecutive diverting rollers, and at least one conduit suction opening of one of the conduit portions is arranged between the bent portions or between the diverting rollers.

9. The value document processing apparatus according to claim 3, wherein the transport device has a transport portion which transports the value documents by means of at least one transport belt, and a belt-free transport portion which transports the value documents without a transport belt, and wherein the at least one conduit suction opening of at least one of the conduit portions is arranged at the transition point between the transport portions.

10. The value document processing apparatus according to claim 3, wherein the checking device has an optical sensor with a sensor window arranged at the transport path, and wherein the at least one conduit suction opening of one of the at least two conduit portions is arranged at or opposite the sensor window.

11. The value document processing apparatus according to claim 3, wherein at least one of the conduit portions has a guiding device for value documents, in which the at least one conduit suction opening is formed.

12. The value document processing apparatus according to claim 3, wherein the guiding device has ribs extending in the transport direction between which the at least one conduit suction opening is arranged.

13. A value document processing apparatus comprising:

an input for value documents to be processed, an output and/or a storage device for processed value documents, a transport device for singled transport of value documents from the input along a transport path to the output or the storage device, a housing, a checking device arranged in the housing for checking value documents transported in singled form past it, and a suction conduit system for suction air, including a port for communication with a suction unit for sucking air with dust out of the suction conduit system, at least one hand cleaning portion connected to the port and having a hand cleaning suction opening movable in the area of the checking device relative thereto, and/or at least two conduit portions connected to the port and having conduit suction openings arranged at different portions of the transport path and directed onto the transport path, through which openings dust is transportable from value documents transported along the transport path, wherein the transport path has a bent portion, and at least one conduit suction opening of one of the conduit portions is arranged at the bent portion.

14. The value document processing apparatus according to claim 13, wherein the transport device has at least one diverting roller at which the direction of the transport path is changed, and wherein at least one conduit suction opening of the at least one conduit portion is arranged at the diverting roller.

15. The value document processing apparatus according to claim 13, wherein the transport path has two consecutive bent portions, or the transport device has two consecutive diverting rollers, and at least one conduit suction opening of one of the conduit portions is arranged between the bent portions or between the diverting rollers.

16. The value document processing apparatus according to claim 13, wherein the transport device has a transport portion which transports the value documents by means of at least one transport belt, and a belt-free transport portion which transports the value documents without a transport belt, and wherein the at least one conduit suction opening of at least one of the conduit portions is arranged at the transition point between the transport portions.

17. The value document processing apparatus according to claim 13, wherein the checking device has an optical sensor with a sensor window arranged at the transport path, and wherein the at least one conduit suction opening of one of the at least two conduit portions is arranged at or opposite the sensor window.

18. The value document processing apparatus according to claim 13, wherein at least one of the conduit portions has a guiding device for value documents, in which the at least one conduit suction opening is formed.

19. The value document processing apparatus according to claim 13, wherein the guiding device has ribs extending in the transport direction between which the at least one conduit suction opening is arranged.

20. A value document processing apparatus comprising:

an input for value documents to be processed, an output and/or a storage device for processed value documents, a transport device for singled transport of value documents from the input along a transport path to the output or the storage device, a housing, a checking device arranged in the housing for checking value documents transported in singled form past it, and a suction conduit system for suction air, including a port for communication with a suction unit for sucking air with dust out of the suction conduit system, at least one hand cleaning portion connected to the port and having a hand cleaning suction opening movable in the area of the checking device relative thereto, and/or at least two conduit portions connected to the port and having conduit suction openings arranged at different portions of the transport path and directed onto the transport path, through which openings dust is transportable from value documents transported along the transport path, wherein the transport device has a transport portion which transports the value documents by means of at least one transport belt, and a belt-free transport portion which transports the value documents without a transport belt, and wherein the at least one conduit suction opening of at least one of the conduit portions is arranged at the transition point between the transport portions.

21. The value document processing apparatus according to claim 20, wherein the checking device has an optical sensor with a sensor window arranged at the transport path, and wherein the at least one conduit suction opening of one of the at least two conduit portions is arranged at or opposite the sensor window.

22. The value document processing apparatus according to claim 20, wherein at least one of the conduit portions has a guiding device for value documents, in which the at least one conduit suction opening is formed.

23. The value document processing apparatus according to claim 20, wherein the guiding device has ribs extending in the transport direction between which the at least one conduit suction opening is arranged.

24. A value document processing apparatus comprising:

an input for value documents to be processed, an output and/or a storage device for processed value documents, a transport device for singled transport of value documents from the input along a transport path to the output or the storage device, a housing, a checking device arranged in the housing for checking value documents transported in singled form past it, and a suction conduit system for suction air, including a port for communication with a suction unit for sucking air with dust out of the suction conduit system, at least one hand cleaning portion connected to the port and having a hand cleaning suction opening movable in the area of the checking device relative thereto, and/or at least two conduit portions connected to the port and having conduit suction openings arranged at different portions of the transport path and directed onto the transport path, through which openings dust is transportable from value documents transported along the transport path, wherein at least one of the conduit portions has a guiding device for value documents, in which the at least one conduit suction opening is formed.

25. The value document processing apparatus according to claim 24, wherein the guiding device has ribs extending in the transport direction between which the at least one conduit suction opening is arranged.

26. The value document processing apparatus according to claim 1, further comprising at least two conduit portions connected to the port and having conduit suction openings arranged at different portions of the transport path and directed onto the transport path, through which openings dust is transportable from value documents transported along the transport path.

27. The value document processing apparatus according to claim 26, wherein the conduit suction openings of the at least two conduit portions or wherein one of the at least two conduit portions having at least two conduit suction openings are so arranged that dust is sucked from two different sides of a value document.

28. The value document processing apparatus according to claim 26, wherein at least one of at least two conduit portions has altogether several conduit suction openings which are arranged perpendicular to the transport direction of the value documents.

29. The value document processing apparatus according to claim 26, wherein the input has a singling device for singling value documents of a stack of value documents to be processed and transferring them to the transport device, and wherein at least one conduit suction opening of at least one of the conduit portions is arranged at the singler and/or at a transition point between the singler and the transport device.

30. The value document processing apparatus according to claim 26, wherein the transport path has a bent portion, and at least one conduit suction opening of one of the conduit portions is arranged at the bent portion.

31. The value document processing apparatus according to claim 26, wherein the transport device has at least one diverting roller at which the direction of the transport path is changed, and wherein at least one conduit suction opening of the at least one conduit portion is arranged at the diverting roller.

32. The value document processing apparatus according to claim 26, wherein the transport path has two consecutive bent portions, or the transport device has two consecutive diverting rollers, and at least one conduit suction opening of one of the conduit portions is arranged between the bent portions or between the diverting rollers.

33. The value document processing apparatus according to claim 26, wherein the transport device has a transport portion which transports the value documents by means of at least one transport belt, and a belt-free transport portion which transports the value documents without a transport belt, and wherein the at least one conduit suction opening of at least one of the conduit portions is arranged at the transition point between the transport portions.

34. The value document processing apparatus according to claim 26, wherein the checking device has an optical sensor with a sensor window arranged at the transport path, and wherein the at least one conduit suction opening of one of the at least two conduit portions is arranged at or opposite the sensor window.

35. The value document processing apparatus according to claim 26, wherein at least one of the conduit portions has a guiding device for value documents, in which the at least one conduit suction opening is formed.

36. The value document processing apparatus according to claim 26, wherein the guiding device has ribs extending in the transport direction between which the at least one conduit suction opening is arranged.

37. The value document processing apparatus according to claim 26, wherein the suction conduit system has a distributing device which is switchable back and forth at least between a hand cleaning position in which dust will be sucked through the hand cleaning portion, and an operational cleaning position in which dust will be sucked through the at least two conduit portions.

38. The value document processing apparatus according to claim 37, wherein the housing has a housing opening through which access is possible at least to the checking device, and a cover element for covering the housing opening, said cover element being movable between an open position in which access to the checking device is possible, and a covering position in which the housing opening is covered at least partly, and wherein the position of the distributing device is adjustable in dependence on the position of the cover element and/or a motion of the cover element between the open position and the covering position.

39. The value document processing apparatus according to claim 37, wherein the checking device has an optical sensor, and is shiftable from an operating state in which a check of value documents is performable by the checking device, to a cleaning state in which the optical sensor is accessible, and back to the operating state, and wherein the position of the distributing device is adjustable in dependence on the state of the checking device and/or a change of the state of the checking device.

40. The value document processing apparatus according to claim 38, including a drive controllable by a control device for moving the cover element, and wherein the control device is arranged to control both the drive and the distributing device.

41. The value document processing apparatus according to claim 38, including a drive controllable by a control device for changing the state of the checking device, and wherein the control device is arranged to control both the drive and the distributing device.

42. The value document processing apparatus according to claim 38, wherein a common drive source is provided for moving the cover element or for changing the state of the checking device and for changing the position of the distributor device.

* * * * *